US011384486B2

(12) United States Patent
Piguet

(10) Patent No.: US 11,384,486 B2
(45) Date of Patent: Jul. 12, 2022

(54) METHOD FOR LAYING A RAIL OF A RAILWAY TRACK

(71) Applicant: MATISA MATERIEL INDUSTRIEL S.A., Crissier (CH)

(72) Inventor: Jean-Claude Piguet, Cossonay (CH)

(73) Assignee: MATISA Materiel Industriel S.A., Crissier (CH)

( * ) Notice: Subject to any disclaimer, the term of this patent is extended or adjusted under 35 U.S.C. 154(b) by 269 days.

(21) Appl. No.: 16/616,159

(22) PCT Filed: May 18, 2018

(86) PCT No.: PCT/EP2018/063168
§ 371 (c)(1),
(2) Date: Nov. 22, 2019

(87) PCT Pub. No.: WO2018/215356
PCT Pub. Date: Nov. 29, 2018

(65) Prior Publication Data

US 2020/0157746 A1 May 21, 2020

(30) Foreign Application Priority Data

May 22, 2017 (FR) ..... 1754528

(51) Int. Cl.
*E01B 31/18* (2006.01)
*E01B 29/17* (2006.01)
*E01B 29/44* (2006.01)

(52) U.S. Cl.
CPC ..... *E01B 31/18* (2013.01); *E01B 29/17* (2013.01); *E01B 29/44* (2013.01); *E01B 2201/02* (2013.01)

(58) Field of Classification Search
CPC ..... E01B 31/18; E01B 29/17; E01B 29/44; E01B 2201/02; E01B 5/02; E01B 29/00;
(Continued)

(56) References Cited

U.S. PATENT DOCUMENTS 3,566,796 A * 3/1971 Herrick ..... E01B 31/18 104/2
4,860,727 A * 8/1989 Eads ..... E01B 11/46 126/271.2 A (Continued)

FOREIGN PATENT DOCUMENTS

DE 102006049408 A1 * 4/2008 ..... E01B 31/04
DE 102006049408 A1 4/2008

*Primary Examiner* — S. Joseph Morano
*Assistant Examiner* — Cheng Lin
(74) *Attorney, Agent, or Firm* — Laurence A. Greenberg; Werner H. Stemer; Ralph E. Locher

(57) ABSTRACT

A work train lays a rail of a railway track. The work train has a heating device with a heating zone, gas burners, and a radiant body interposed between the gas burners and the heating zone. The radiant body has openings that open into the heating zone. The work train is moved in a laying direction, so that at each moment a portion of the rail to be fixed passes through the heating zone. Heat is supplied to the rail to be fixed through the heating zone by feeding the gas burner so that no flame emerges from the openings in the heating zone and that at least 75% of the heat supplied to the rail is transmitted by radiation from the radiant body. Then the rail is fixed after the heat has been applied to a tie of the railway track behind the heating zone in the laying direction.

19 Claims, 3 Drawing Sheets

(58) Field of Classification Search
CPC ..... E01B 29/02; E01B 29/04; E01B 29/05; E01B 29/16; E01B 29/40; E01B 29/42; E01B 31/00; E01B 31/02; E01B 37/00; F23D 11/004; F23D 14/12; F23D 14/14; F23D 14/147
See application file for complete search history.

(56) References Cited

U.S. PATENT DOCUMENTS

| | | | | | |
|---|---|---|---|---|---|
| 5,237,143 | A * | 8/1993 | Scheuchzer | E01B 31/18 | 104/15 |
| 5,299,504 | A * | 4/1994 | Abele | E01B 31/18 | 104/2 |
| 6,308,635 | B1 * | 10/2001 | Abele | E01B 31/18 | 104/2 |
| 10,676,873 | B2 * | 6/2020 | Ganz | E01B 29/44 | |

* cited by examiner

METHOD FOR LAYING A RAIL OF A RAILWAY TRACK

TECHNICAL FIELD OF THE INVENTION

The invention relates to a method for laying a rail of a railway track, comprising heating the rail, and to a work train for implementing such a laying method.

PRIOR ART

The rails of railway tracks are subjected to major temperature variations depending on the season and weather conditions. Rails tend to lengthen and expand as a result of an increase in temperature and, conversely, to contract as a result of a drop in temperature.

Nowadays, rails are laid continuously and therefore cannot vary in length under the effect of temperature variations. Rails are attached to the track at an average temperature referred to as a "neutral" temperature, the value of which differs depending on the climatic region. When the ambient temperature exceeds the annual average, the rails, being unable to expand, are subjected to a compressive force that tends to push the track out its path. Conversely, when the ambient temperature is lower than the annual average, the rails, being unable to contract, are subjected to a tractive force that tends to pull the track out its path.

If the temperature of the rail is not controlled at the time of laying, it is necessary to perform operations referred to as mechanical "neutralization" operations after laying, and to restrict travel speeds until these operations have been completed. Mechanical neutralization consists in cutting a slice from the rail, the thickness of which is a function of a difference observed between the temperature at the time of the intervention and the "neutral" temperature of the location, unbolting the rail and stretching it to fill the space left by the removed slice, before bolting the rail back on and, if appropriate, rewelding it. Until this neutralization operation has been carried out, the travel speed on the track must be restricted, most usually to 50 kph. It is understood that organizing such works results in significant traffic disturbances, both during the neutralization intervention and during the preceding phase, between laying the rail and carrying out neutralization.

Directly attaching the rails continuously heated to a value close to or equal to the "neutral" temperature helps achieve the best results in terms of minimizing traffic disturbances.

One solution for continuously heating rails used today requires the use of induction technology. This method helps obtain heats that are sufficiently accurate to ensure the rails are laid within the required tolerance of the "neutral" temperature. This can be referred to as fine direct thermal neutralization. However, the equipment needed for the intervention is relatively complex, because it requires a power generator, as well as cooling for the power circuits, the generator and the inductors.

For worksites requiring subsequent ballast stabilization, a thermal "pre-neutralization" procedure has been proposed, which consists in bringing the rail, before it is attached to the tie, to a temperature sufficiently close to the "neutral" temperature of the location, but without guaranteeing that the "neutral" temperature is reached. Such "pre-neutralization" advantageously allows travel to resume immediately at a speed of the order to 80 kph instead of 50 kph, until the final mechanical neutralization operations described previously are carried out. One method for carrying out this thermal pre-neutralization consists in sprinkling the rails with hot water, yet this solution has operational drawbacks, in particular in terms of efficiency and the transportation and removal of the water, which reduce its benefits.

Moreover, document U.S. Pat. No. 6,308,635 proposes heating the rail already laid on the ground by using a gas heating module comprising a hot air generator for heating the rail by convection. This convective heating can be supplemented by radiant heating obtained by radiant panels positioned between the burners and the heated portion of the rail, the radiant panels being perforated in such a way as to allow the flames to pass through them and enter the heating chamber where the portion of rail to be heated is located. However, such a heating method, which is essentially convective and secondarily radiant, is difficult to control, particularly because it depends on the air currents.

DISCLOSURE OF THE INVENTION

The aim of the invention is to overcome the disadvantages of the prior art and to propose a heating method that offers a high level of performance in terms of efficiency, reliability and operating quality.

For this purpose, a first aspect of the invention proposes a method for laying a rail of a railway track using a work train comprising at least one heating device having at least one heating zone, one or more gas burners, and one or more radiating bodies interposed between the gas burner or burners and the heating zone, the radiating body or bodies being perforated by openings opening into the heating zone, in which method:

- the work train is moved in a laying direction, such that, at each instant, a portion of the rail passes through the heating zone;
- heat is applied to the portion of the rail passing through the heating zone using the heating device, the gas burner or burners being supplied such that no flame emerges from the openings into the heating zone and such that at least 75%, and preferably at least 80%, and preferably at least 85% of the heat applied to the portion of the rail is transmitted by radiation from the radiating body or bodies;
- the portion of the rail is attached, after applying the heat, to a sleeper of the railway track situated behind the heating zone in the laying direction.

The radiation, which is essentially in the infrared spectrum, ensures excellent heating efficiency with low losses. Radiation is not influenced by the wind or other climatic parameters.

The perforations are useful in that they optimize the heating of the radiating bodies, but should not lead to a predominance of convection in the transfer of heat to the portion of rail.

Naturally, the heating power should be modulated depending on the external conditions in order to obtain a desired setpoint temperature for the rail.

According to one embodiment, the invention involves modulating, depending on one or more control parameters, one or more combustion parameters from the following parameters concerning the supply to one or more modulated burners of the gas burner or burners: flow rate of fuel, flow rate of oxidizer, flow rate of a fuel/oxidizer mixture.

According to another embodiment, the gas burner or burners comprise at least two burners, and preferably at least four burners, and the number of activated burners is modulated depending on one or more control parameters. In particular, the gas burner or burners can comprise at least one pair of adjacent gas burners situated one behind the other in the laying direction and/or the burner or burners can comprise at least one pair of opposing burners, situated to either side of a median plane of the heating zone parallel to the laying direction.

Preferably, the control parameter or parameters include one or more of the following measured or estimated parameters: a temperature of the portion of the rail before heating, a temperature of the portion of the rail after heating, a temperature of the portion of the rail during heating, an outdoor ambient temperature, a speed of movement of the work train, a speed of movement of the rail relative to the heating device, a heating duration, a difference between a setpoint temperature and a measured temperature of the portion of the rail before heating, a difference between a setpoint temperature and a measured temperature of the portion of the rail after heating, a difference between a setpoint temperature and a measured temperature of the portion of the rail while heat is being applied, an ambient humidity, or a wind speed. In particular, one or more of the following procedures may be carried out:

- measuring at least one temperature of the portion of the rail after heat has been applied using a pyrometer arranged at an exit zone of the heating zone or behind the heating zone in the laying direction;
- measuring at least one temperature of the portion of the rail before heat has been applied using a pyrometer arranged at an entrance zone of the heating zone or in front of the heating zone in the laying direction;
- measuring at least one temperature of the portion of the rail while heat is being applied using a pyrometer arranged inside the heating zone.

According to a particularly advantageous embodiment, the portion of the rail situated in the heating zone is raised off the track, and the portion of the rail is positioned, after applying the heat, on the sleeper before attaching the portion of the rail to the sleeper. Raising the portion of the rail into the heating zone helps better surround the rail, heating it not only from above, but also from the sides and, optionally, from below, either by direct radiation from the radiating body or bodies, or by indirect radiation, originating from the radiating bodies, but reflected by a wall of the heating zone, in order to apply heat in a uniform manner to the periphery of the portion of the rail and minimize losses. The fact that the heating zone is separated from the track, and in particular from the tie, allows high heating power to be implemented, if required, without risk to the track.

According to an alternative embodiment, the portion of the rail situated in the heating zone is laid on the track. In this case, care must be taken to ensure that the heat applied is directed essentially towards the rail, in order to minimize the heat applied to the other components of the track.

In order to obtain reproducible positioning of the portion of the rail to be attached that is passing through the heating zone, one or more of the following procedures, in particular, may be carried out:

- the portion of the rail is guided relative to a frame of the work train such that the portion of the rail passes through the heating zone while the work train moves.
- the heating device is guided relative to a frame of the work train such that the portion of the rail passes through the heating zone while the work train moves.
- the heating device is guided relative to the portion of the rail, preferably by rolling the heating device over the portion of the rail, such that the portion of the rail passes through the heating zone while the work train moves.

According to one embodiment, the work train moves in the laying direction without stopping.

The laying method according to the invention can be implemented, in particular, when laying a new track for the first time, or when carrying out renewal or renovation work. In particular, and according to a preferred aspect of the invention, it concerns a method for renewing or renovating a railway track, comprising, in particular, the removal of an old rail, and the laying of a new or renovated rail, laying being carried out according to the previously described laying method.

According to another aspect of the invention, it concerns a rail work train for implementing the method as previously described.

In particular, the invention concerns a work train comprising at least one heating device having at least one heating zone, one or more gas burners, and one or more radiating bodies interposed between the gas burner or burners and the heating zone, the radiating body or bodies being perforated by openings opening into the heating zone, the work train comprising:

- pulling means for moving the work train in a laying direction, such that, at each instant, a portion of the rail, not attached to a sleeper, passes through the heating zone;
- means for supplying the gas burner or burners such that no flame emerges from the openings in the heating zone and such that at least 75%, and preferably at least 80%, and preferably at least 85% of the heat applied to the portion of the rail is transmitted by radiation from the radiating body or bodies.

Preferably, the work train comprises means for raising the portion of the rail situated in the heating zone off the track, and means for positioning the portion of the rail, after applying the heat, on the sleeper before attaching the portion of the rail to the sleeper. As previously explained, raising the portion of the rail into the heating zone helps better surround the rail, heating it not only from above, but also from the sides and, optionally, from below, either by direct radiation from the radiating body or bodies, or by indirect radiation, originating from the radiating bodies, but reflected by a wall of the heating zone, in order to apply heat in a uniform manner to the periphery of the portion of the rail and minimize losses. The fact that the heating zone is separated from the track, and in particular from the tie, allows high heating power to be implemented, if required, without risk to the track.

According to one embodiment, the heating device comprises one or more heating modules, each heating module comprising a heating zone, one or more gas burners, and one or more radiating bodies interposed between the gas burner or burners of the heating module and the heating zone of the heating module. Preferably, the heating module or modules comprise at least one guided heating module that is provided with guide means for guiding the portion of the rail in the heating zone of the guided heating module, the guide means preferably comprising rollers rolling over the portion of the rail, the rollers preferably supporting the guided heating module.

BRIEF DESCRIPTION OF THE FIGURES

Other features and advantages of the invention will become clearer upon reading the description that follows, with reference to the appended drawings, which show.

For the purpose of greater clarity, elements that are identical or similar are denoted by identical reference signs in all the figures.

DETAILED DESCRIPTION OF EMBODIMENTS

Figure 1:
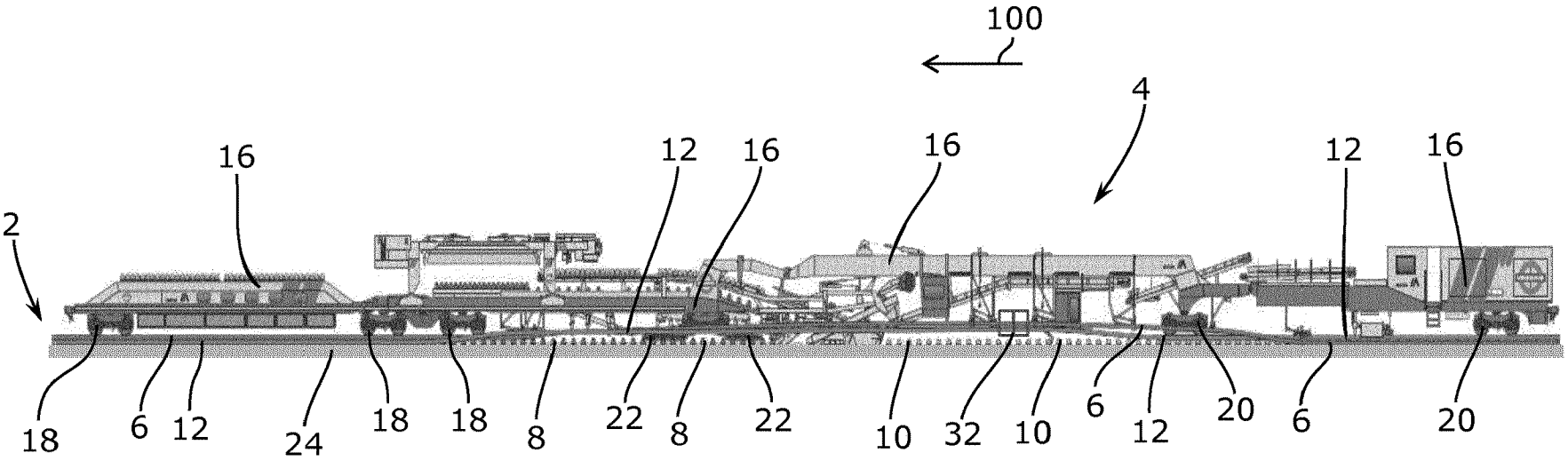
FIG. 1, a schematic view of a railway track rail laying worksite, according to the method of the invention.

FIG. 1 shows an overall view of a railway track renewal worksite 2 in which a work train 4 (shown in part) is used to remove the old rails 6 (front sector) and the old tie 8, and then to replace them with new tie 10 and new rails 12, the whole procedure taking place continuously as the train moves forward in the laying direction 100. The work train 4 comprises wagons 16 resting on bogies 18, 20 running on the old rails 6 at the front portion of the work train 4 and on the new rails 12 at the rear portion of the work train 4. A middle portion of the work train 4 rests on crawler tracks 22 which, in the absence of rails on the track 2 in this portion of the worksite, run directly over the old tie 8 before they are removed.

On a front section of the worksite, tools allow the old rails 6 to be detached from the tie 8. As they are removed, the old rails 6 are raised and rested on the ballast 24 on the sides of the track. On the next section of the worksite, the old tie 8 are exposed, allowing them to be removed using a set of removal tools and replaced with new tie 10 using a set of laying tools. The new rails 12 which, before the work train 4 passes, have been arranged on the ground to either side of the track 2, are raised and positioned in accordance with the desired geometry of the track 2, before being laid on the new tie 10. The final attachment of the new rails 12 is carried out by means of rail fasteners after the work train 4 has passed.

In order to prevent or limit the risk of gaps or breakages in the track likely to be caused by variations in the dimensions of the rails 12 as a result of more severe climatic or meteorological conditions, the final attachment of the new or renovated rails 12 to the tie is carried out while bringing these metal profile sections to an average temperature of the laying location, referred to as a "pre-destressing" or "destressing" temperature.

To this end, the section of new or renovated rail to be laid 12 is brought to a setpoint temperature in a conditioning zone 28 situated in front of and close to its attachment zone 30 where it is attached to one or more tie 10. When the intervention on the worksite takes place at a time when the ambient temperature is lower than the setpoint temperature, referred to as the "pre-destressing" or "destressing" temperature, this adjustment involves heating the rail, in which case the conditioning zone 28 is a heating zone.

Figure 2:
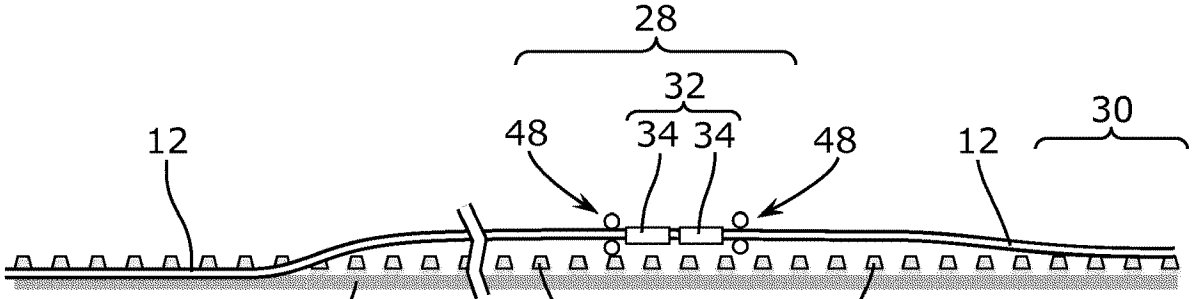
FIG. 2, a detailed schematic view of the worksite of FIG. 1, showing the heating of a rail to be attached according to the method of the invention.
Figure 3:
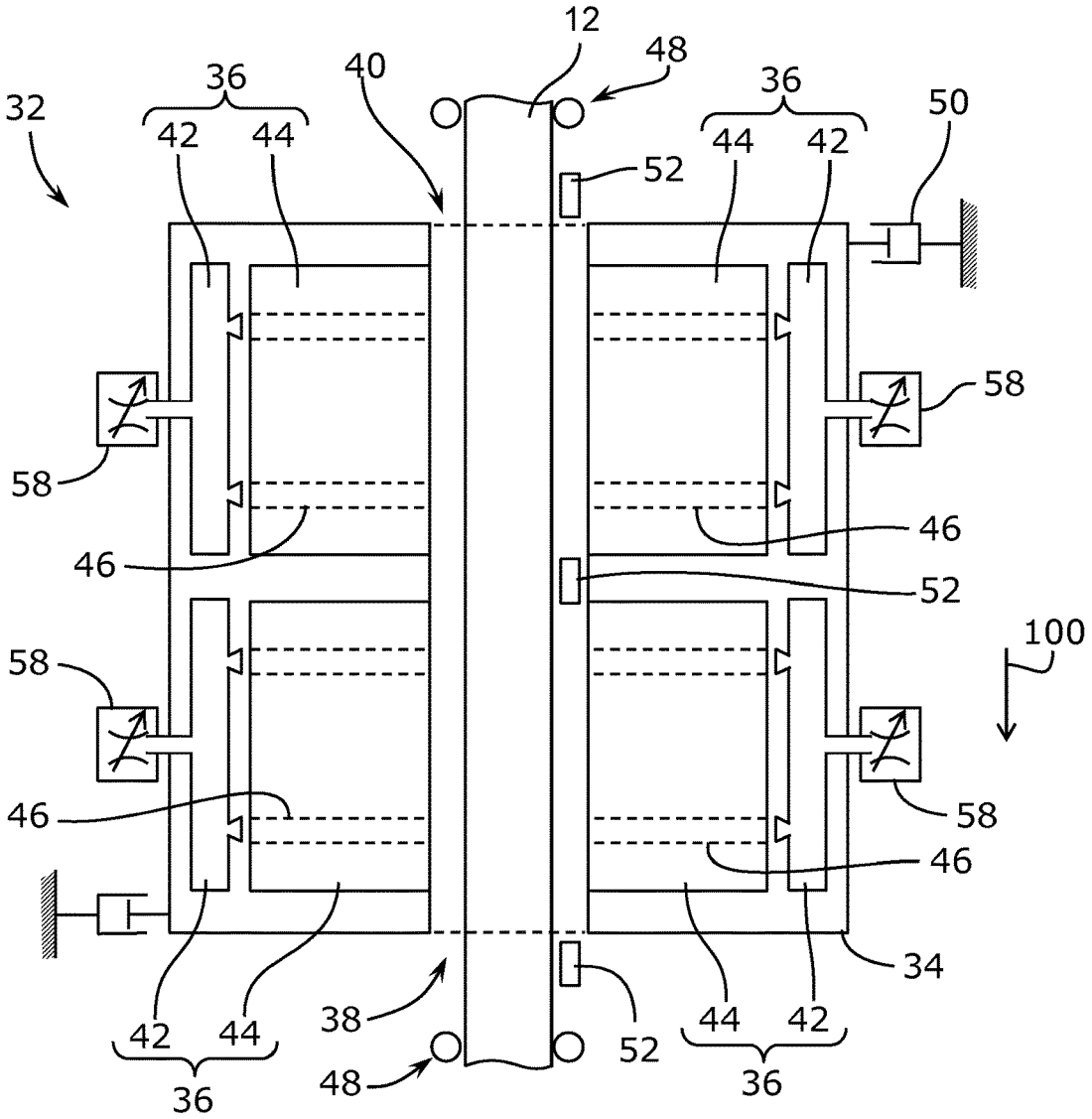
FIG. 3, a schematic view of the top of a heating module of a heating device implementing the method of the invention.
Figure 4:
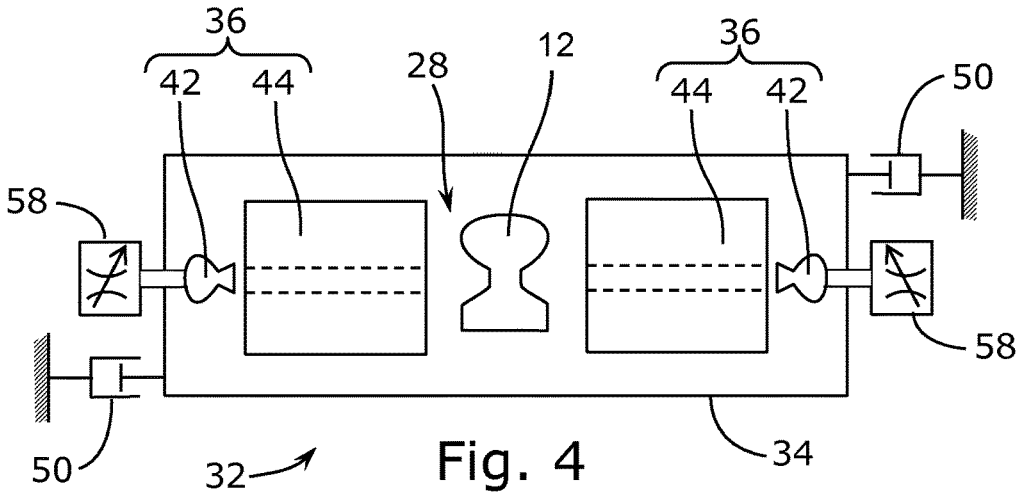
FIG. 4, a schematic front view of the heating module of FIG. 3.

To this end, the invention proposes using a heating device 32 shown schematically in FIGS. 2 to 4, functioning essentially by thermal radiation. The heating device 32 comprises at least one heating module 34 having at least one, preferably at least two, and particularly preferably, as shown in FIG. 3, at least four heating units 36, delimiting an elongate heating zone 28 situated at a distance from the track and oriented in the laying direction 100 of the work train 4 and open at a front end 38 and at a rear end 40. The four heating units 36 are arranged laterally to either side of the heating zone, two closer to the entrance and the other two closer to the exit.

Each heating unit 36 comprises a unit of one or more burners 42 and a radiating body 44, interposed between the burner or burners 42 and the heating zone 28. The radiating body 44 is preferably perforated by openings 46 opening into the heating zone 28, and that can be arranged either opposite the burners 42 or offset from the latter.

Guide means 48 are provided at the entrance 38 and at the exit 40 of the heating zone 28 of the heating device in order to guide the rail 12 through the heating zone 28. In this preferred embodiment, the portion of the rail 12 passing through the heating zone 28 is raised, i.e. situated vertically at a distance above its final position at the end of the laying process. The heating device can itself be provided with one or more actuators 50 or a passive positioning mechanism for positioning it correctly with respect to the rail 12, and compensating for variations in the positioning of the work train 4 relative to the desired trajectory of the track. Preferably, the guide means 48 include rollers rolling over the rail 12 and, if applicable, supporting the heating unit 36.

Figure 5:
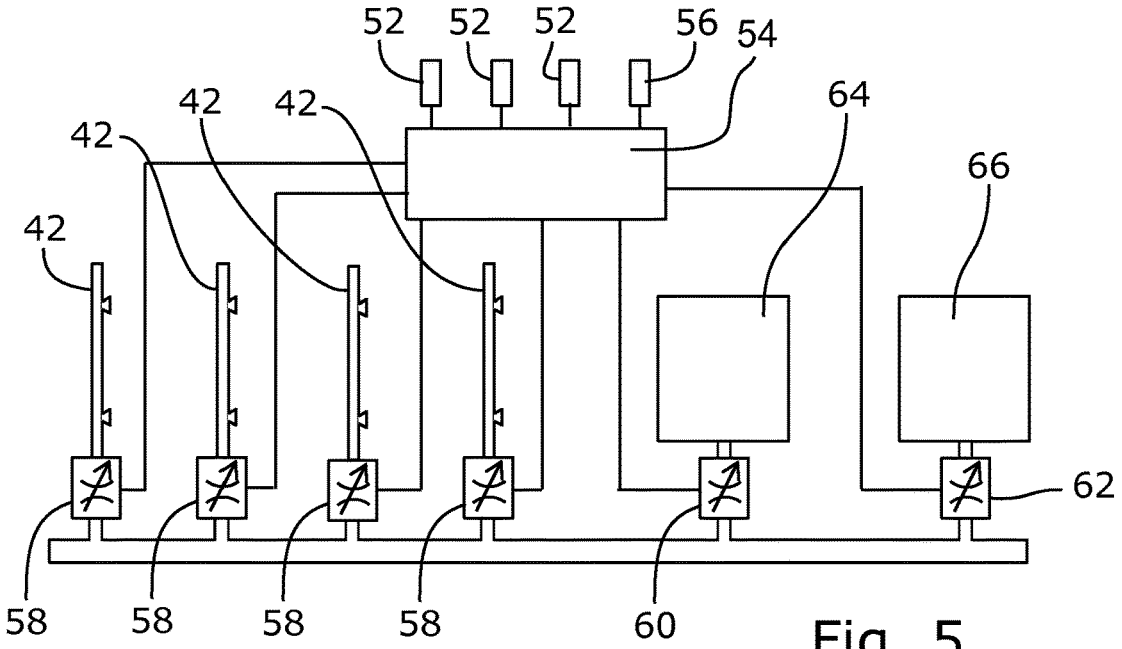
FIG. 5, a schematic view of a control unit of the heating module of FIGS. 3 and 4.

Pyrometers 52 are positioned at the entrance 38 of the heating zone 28, inside the heating zone 28 and at the exit 40 of the heating zone 28 and, if applicable, directly next to the attachment zone 30. These pyrometers 52 are linked to a control unit 54 shown in FIG. 5, which receives signals from other sensors 56 such as, for example: a sensor sensing the speed of the work train 4, a sensor sensing the speed of the rail to be attached, an ambient temperature sensor, an atmospheric pressure sensor, and/or an ambient humidity sensor. The control unit 54 is therefore capable of measuring, estimating or calculating one or more of the following parameters: a temperature of the portion of the rail to be attached before heating, a temperature of the portion of the rail to be attached after heating, a temperature of the portion of the rail to be attached during heating, an outdoor ambient temperature, a speed of movement of the work train 4, a speed of movement of the rail relative to the heating device, a quantity of heat transmitted to the portion of the rail by the heating device.

Moreover, the control unit 54 contains, in its memory, a setpoint temperature that can have been input or programmed, and is representative of the "pre-destressing" or "destressing" temperature desired in the attachment zone 30, which makes it possible to determine, if applicable, a difference between the setpoint temperature and a measured temperature of the portion of the rail to be attached before heating, a difference between the setpoint temperature and a measured temperature of the portion of the rail to be attached after heating, or a difference between the setpoint temperature and a measured temperature of the portion of the rail to be attached during heating.

Finally, the control unit 54 is linked to proportional solenoid valves 58 for modulating the flow rate of oxidizer and/or fuel for supplying the burners, and to igniters for controlling the ignition of the burners and to proportional solenoid valves 60, 62 for controlling the general supply of fuel gas originating from a gas tank 64 and oxidizer gas originating from a compressor 66.

It is therefore possible to modulate the heating power of each heating unit in a relatively continuous manner, over a range around a nominal value, for example between 50% and 150% of the nominal value, by varying the flow rate of the oxidizer and/or the fuel at the solenoid valves 58, 60, 62. Outside this modulation range, greater variations can be obtained by completely switching off certain heating units 36, or igniting them.

When the work train 4 is moving in a laying direction 100, the rail to be attached 12 moves, relative to the heating device 28, in the opposite direction, and is guided such that, at each instant, a raised portion of the rail to be attached 12 is passing through the heating zone 28. If applicable, the positioning of the heating device is adjusted by the actuators 50 or the positioning mechanism. The radiating bodies 44 are arranged so as to be close to the portion of the rail to be attached 12, and preferably at a distance of less than 20 cm, and preferably less than 10 cm.

Thus, at each instant, and depending on the advancement of the work train 4, a portion of the rail to be attached 12 passes through the heating zone 28, where it is heated by the heating device 32 before exiting the heating zone 28 and being conveyed to the attachment zone 30, where it is laid on a sleeper 10 of the railway track.

The control unit 54 determines, using a calculation algorithm, depending on all or some of the parameters discussed previously, the number of burners 42 and/or the flow rate of oxidizer and/or fuel required in order to heat the rail to be attached 12.

Remarkably, the gas burner or burners 42 are supplied such that at least 75%, and preferably at least 80%, and preferably at least 85% of the heat is transmitted to the rail by radiation from the radiating body or bodies 44 and no flame emerges from the openings 46 in the heating zone 28. The only function of the openings 46 is therefore to cause swift and uniform heating of the radiating bodies 44.

Preferably, the work train moves in the laying direction without stopping, at a speed that is, in practice, higher than 30 mm/second, and preferably higher than 100 mm/second.

Naturally, the examples shown in the figures and discussed above are given as purely illustrative and non-limiting examples.

Figure 6:
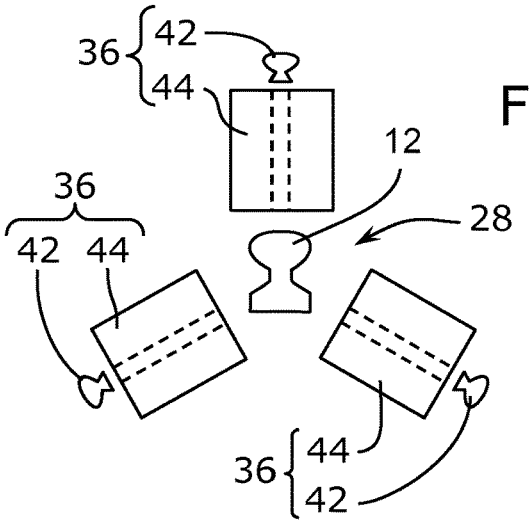
FIG. 6, a schematic front view of a heating module according to a first variant.
Figure 7:
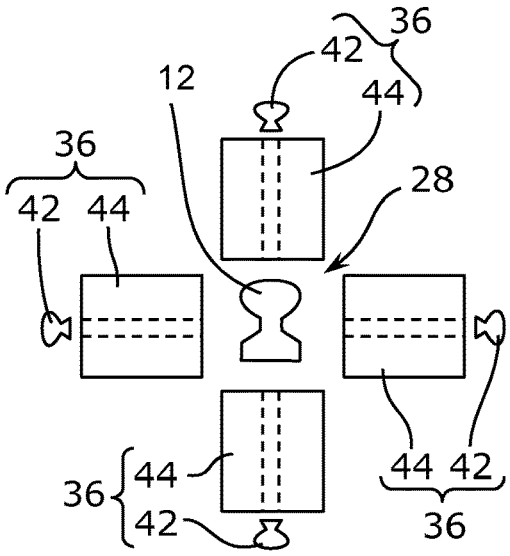
FIG. 7, a schematic front view of a heating module according to a second variant.
Figure 8:
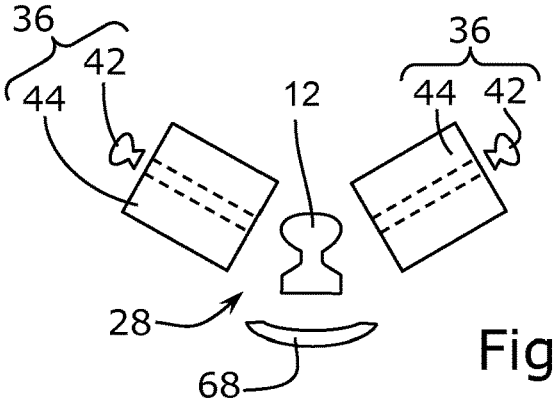
FIG. 8, a schematic front view of a heating module according to a third variant.

The number of heating units 36 are their positioning in each heating module 34 can vary. It is advantageous to have at least two heating units 36 opposite each other to either side of the heating zone 28 (as shown in FIGS. 3 and 4) or, more generally, radiating into the heating zone at different angles. In particular, it is possible to take advantage of the lifting of the portion of the rail 12 passing through the heating zone 28 in order to direct at least some of the thermal radiation in such way as to reach the lower face of the rail. In this regard, arrangements with three heating units distributed at 120° (FIG. 6) or four heating units distributed at 90° (FIG. 7) around the heating zone are perfectly envisageable. Reflective surfaces 68 delimiting a portion of the heating zone 28 (FIG. 8) can also be provided, in order to distribute the heat around the periphery of the rail. It is also advantageous to have several heating units 36 arranged in sequence in the longitudinal direction of advancement of the vehicle, as shown in FIG. 3, or indeed several heating modules 34 as shown in FIG. 2, for allowing gradual multi-stage heating. The heating modules 34 situated in sequence can be directly adjacent or separated by an isothermal insulation section. They can also be separated by an open-air section. The heating module or modules 34 can be suspended from a load-bearing structure of one of the wagons of the middle portion of the work train 4. They can also be supported independently by wheels or crawler tracks advancing on the track, if applicable linked by open-air couplings.

If appropriate, only some of the gas burners 42 can be equipped with a modulation solenoid valve 58.

It is also possible to envisage that the solenoid valves 58 are not proportional, but operate in on/off mode, the number of heating units 36 being switched off or on depending on requirements. In this event, it is possible to envisage that the solenoid valves 60, 62 providing a general supply of fuel and oxidizer may be proportional valves, in order to ensure a certain degree of continuity in variation, or that they may be on/off valves, in which case the heat applied is modulated only in stages, by changing the number of heating units 36 supplied. It is also possible to envisage, in the absence of proportional solenoid valves, a pulsed operating mode, in which some of the gas burners 42 are ignited intermittently. It is also possible to envisage articulating the heating units 36 in such a way that they can be quickly moved away from the heating zone 28 when it is necessary to reduce the quantity of heat transmitted to the rail to be laid 12.

As a variant, the heating units use ambient air as the oxidizer, and only the flow rate of the fuel is modulated. In this event, the solenoid valve 62 and the compressor 66 are omitted. In practice, the fuel gas is a propane or LPG fuel.

Depending on the precision of the modulation observed, which will depend on the response time of the heating units 36, the method according to the invention will be able to be used either for thermal pre-neutralization, or even for fine direct thermal neutralization.

The operation of heating the rail to be attached 12 can take place when the rail to be attached 12 is already laid on the tie.

The method for heating rails that has been described above for railway track renovation in which the rails are replaced, can also be used for rail track renovation in which the old rails are relaid, or for a first laying.

The invention claimed is:

1. A method for laying a rail of a railway track using a work train having at least one heating device with at least one heating zone, at least one gas burner, and at least one radiating body interposed between the gas burner and the heating zone, the radiating body being perforated with openings opening into the heating zone, which comprises the steps of:

moving the work train in a laying direction in such a way that at each instant, a portion of the rail not fixed to a tie passes through the heating zone;

applying, by means of the heating device, heat to the portion of the rail that passes through the heating zone; and supplying the gas burner in such a way that no flame emerges from the openings into the heating zone and that at least 75% of the heat applied to the portion of the rail is transmitted by radiation from the radiating body.

2. The method according to claim 1, which further comprises modulating at least one combustion parameter in dependence on at least one control parameter selected from the following group of parameters for supplying at least one modulated burner from among the gas burner: a fuel flow rate, flow rate of an oxidizer, a fuel flow, and a fuel-oxidizer mixture flow rate.

3. The method according to claim 2, which further comprises selecting the control parameter from the following group of measured or estimated parameters: a temperature of the portion of the rail before the heating, a temperature of the portion of the rail after the heating, a temperature of the portion of the rail during the heating, an external ambient temperature, a speed of movement of the work train, a speed of movement of the rail relative to the heating device, a heating duration, a difference between a setpoint temperature and a measured temperature of the portion of the rail before the heating, a difference between a setpoint temperature and a measured temperature of the portion of the rail after the heating, a difference between a setpoint temperature and a measured temperature of the portion of the rail during the heating, an ambient humidity, and a wind speed.

4. The method according to claim 3, which further comprises measuring at least one temperature of the portion of the rail after the heating by means of a pyrometer disposed at an exit zone of the heating zone or behind the heating zone in the laying direction.

5. The method according to claim 3, which further comprises measuring at least one temperature of the portion of the rail before heating, by means of a pyrometer disposed at an inlet zone of the heating zone or in front of the heating zone in the laying direction.

6. The method according to claim 3, which further comprises measuring at least one temperature of the portion of the rail during heating, by means of a pyrometer disposed inside the heating zone.

7. The method according to claim 1, wherein the gas burner has at least two burners, and in that a number of the burners that are activated burners is modulated depending on at least one control parameter.

8. The method according to claim 7, wherein the gas burner has at least one pair of adjacent gas burners that are disposed one behind the other in the laying direction.

9. The method according to claim 7, wherein the burners include at least one pair of opposing burners, disposed on either side of a median plane of the heating zone parallel to the laying direction.

10. The method according to claim 1, which further comprises raising the portion of the rail disposed in the heating zone off of the railway track, and in that the portion of the rail is positioned after the heat is applied to the tie before fixing the portion of the rail to the tie.

11. The method according to claim 1, which further comprises guiding the portion of the rail relative to a frame of the work train in such a way that the portion of the rail traverses the heating zone while the work train moves.

12. The method according to claim 1, which further comprises guiding the heating device relative to a frame of the work train in such a way that the portion of the rail passes through the heating zone while the work train moves.

13. The method according to claim 1, which further comprises guiding the heating device relative to the portion of the rail so that the portion of the rail passes through the heating zone while the work train moves.

14. The method according to claim 13, which further comprises rolling the heating device over the rail portion.

15. The method according to claim 1, which further comprises fixing the portion of the rail after the heat is applied to the tie of the railway track disposed behind the heating zone in the laying direction.

16. A work train, comprising:

at least one heating device having at least one heating zone, at least one gas burner, and at least one radiating body being interposed between said gas burner and said heating zone, said radiating body having perforated openings formed therein opening into said heating zone;

traction means for moving the work train in a laying direction in such a way that at any given point in time, a portion of a rail not fixed to a tie passes through said heating zone; and means for supplying said gas burner in such a way that no flame emerges from said perforated openings into said heating zone and that at least 75% of the heat applied to the portion of the rail is transmitted by radiation from said radiating body.

17. The work train according to claim 16, wherein said heating device has at least one heating module, said at least one heating module having said heating zone, said at least one gas burner, and said at least one radiating body interposed between said at least one gas burner of said heating module and said heating zone of said heating module.

18. The work train according to claim 17, wherein said heating module is at least one guided heating module having guiding means for guiding the portion of the rail in said heating zone of said guided heating module.

19. The work train according to claim 18, wherein said guiding means has rollers that roll on the portion of the rail, said rollers supporting said guided heating module.

* * * * *